United States Patent [19]

Wutscher

[11] 4,203,454

[45] May 20, 1980

[54] SNUFF PROJECTOR

[76] Inventor: Johann H. Wutscher, 141 Brown St., Waltham, Mass. 02154

[21] Appl. No.: 892,624

[22] Filed: Apr. 3, 1978

[51] Int. Cl.[2] ..... A24F 47/00

[52] U.S. Cl. ..... 131/170 R; 124/7

[58] Field of Search ..... 131/170 R; 124/7, 35

[56] References Cited

FOREIGN PATENT DOCUMENTS 2427562 12/1975 Fed. Rep. of Germany ..... 131/170 R 2428313 1/1976 Fed. Rep. of Germany ..... 131/170 R

*Primary Examiner*—Stephen C. Pellegrino

*Attorney, Agent, or Firm*—James J. Cannon, Jr.

[57] ABSTRACT

An apparatus for projecting snuff or powdered tobacco into the nostrils. The apparatus includes a contoured nose positioning member, a normally forward and downward sloping lever member having two depressions therein for holding pinches of snuff positioned under each of the nostrils and a pivoted spring loaded striking member held in pre-operative position by a spring loaded pivoted restraining member. When one end of the spring-loaded restraining member is depressed it releases the spring-loaded striking member to pivot downward forcefully. The striking member hits the rear upward sloping end of the snuff projection lever member causing it to pivot downward quickly and its opposite end to pivot upward quickly, thus projecting the pinches of snuff into the nostrils of the user. A small mirror is provided to insure proper orientation of the users' nostrils prior to projection of the snuff.

5 Claims, 1 Drawing Figure

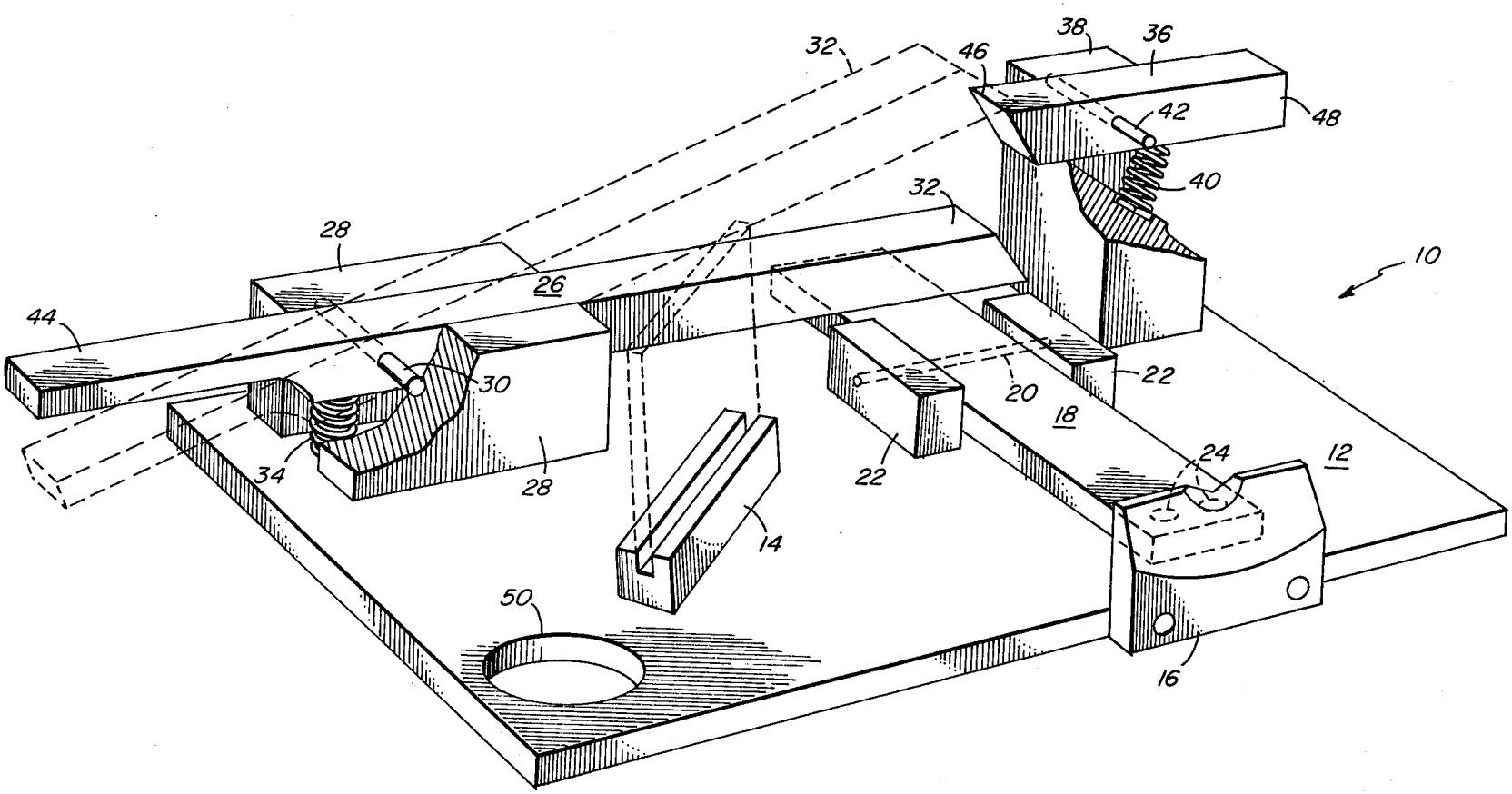
10
12
14
16
18
20
22
22
24
26
28
28
30
32
32
34
36
38
40
42
44
46
48
50

SNUFF PROJECTOR

BACKGROUND OF THE INVENTION

1. Field of the Invention

This invention pertains to the field of tobacco and smoker's accessories, and more particularly to an accessory for use with powdered tobacco or snuff. The object of the invention is to simplify the projection of snuff into the nostrils of the user.

2. Description of the Prior Art

The object of this invention is to provide a device which will project snuff simply and quickly into the nostrils of the user. Snuff, or powdered tobacco, is used by people who wish to enjoy the flavor and other enjoyments of tobacco without the hazards inherent in smoking tobacco products. At various times in history the use of snuff has been socially fashionable. With current trends to discourage the smoking of tobacco products, the use of snuff is becoming more popular and more socially acceptable.

There are two traditional ways of using snuff. One way is to take a pinch between two fingers, tilt one's head backward and inhale deeply as the snuff is dropped into the nostril. This is the more socially graceful and acceptable means. Another means of using snuff is to place a pinch or two of snuff on the side of the forefinger, place the forefinger under the nostrils and inhale deeply. This method of using snuff is aesthetically displeasing and not particularly sanitary. It is generally unacceptable in refined social circles. Even the more acceptable means of using snuff is not particularly graceful and has been a deterrent to the popular acceptance of snuff.

After a diligent search, the inventor could find no snuff projection device, whether patented or not.

The object of the present invention is to provide a simple, effective and reliable device for the projection of snuff into the nostrils. Furthermore, other design criteria for such a device are that it achieve its primary objects in an aesthetically pleasing and socially acceptable manner; that the device should be sanitary to use; and that it be an attractive desk or table accessory when not in use. The device of this invention satisfies all of these design criteria.

SUMMARY OF THE INVENTION

The present invention is a device for the projection of snuff or powdered tobacco into the nostrils of the user which is simple in structure, and effective and reliable in use. It is built in the form of an attractive desk or table accessory. It has a portable base on which all its working components are mounted. At the forward edge of one side of the base is a vertically oriented contoured nose positioning member which the user places against his upper lip such that the upper contoured edge of this member presses against the base of his nose. On the other side, near the middle of the base, a vertical mirror is provided to enable the user to view the correct positioning of his nose. Immediately behind the vertical nose positioning member, is a downward sloping section of an elongated snuff projection lever whose fulcrum is non-centrally mounted just beyond the center of the base, the opposite end of which normally slopes upward. The end of the snuff projection lever which is in close proximity to the nose positioning member has two circular depressions for holding pinches of snuff. These depressions are spaced such that when the snuff projection lever is caused to pivot upwardly the snuff in these depressions will be projected into the nostrils of a nose resting on the nose positioning member.

Positioned horizontally across the rear of the base member are a spring-loaded striking member and a spring-loaded restraining member. The spring loaded striking member is an elongated, spring-loaded, pivotally mounted bar which extends from its pivot block to a position over the rear end of the snuff projection lever. The striking member has a spring under its non-striking end on the opposite side of its fulcrum such that it has a normal tendency to pivot downward to the snuff projection lever. The spring-loaded restraining member is a shorter elongated bar pivotally mounted and spring-loaded such that it normally is in a horizontal position, and is longitudinally aligned with the spring-loaded striking member. Since the function of the spring-loaded restraining member is to prevent the spring-loaded striking member from pivoting downward, it extends slightly beyond the edge of the striking member. Thus, its length is sufficient to engage and restrain the striking edge of the striking member. Both the striking member and the restraining member must have complementary shaped edges such that the striking member can be released and reset conveniently. The restraining member is pivotally mounted and spring-loaded on the outside of its fulcrum, such that when its outer end is depressed, its inner restraining end will pivot upward, releasing the striking edge of the striking member. In its normal, non-operative position the spring of the restraining members maintains a horizontal position, even when engaging the striking edge of the striking member. In the normal pre-operative position of the striking member, the outer end is depressed, pressure is exerted on its spring and its striking end is held in an upward inclined position by the inner edge of the restraining member.

To operate the snuff projection device of the present invention, the striking member is depressed at its outer end so that its striking edge is held in an upward position by the restraining member. The snuff projection lever is pivoted downward such that its forward edge is positioned in close proximity to the nose positioning member. A pinch of snuff is placed in each depression in the snuff projection member. The upper lip is placed against the nose positioning member such that the base of the nose rests on its contoured upper edge and the nostrils overhang the snuff depressions. The outer end of the restraining member is depressed, releasing the striking edge of the spring-loaded striking member. The forward edge of the spring-loaded striking member is pivoted forcefully downward under pressure from its spring to strike the upward inclining edge of snuff projection member. This causes the opposite end of the snuff projection lever to pivot upward quickly, thereby projecting the snuff in its depressions into the nostrils of the user.

The snuff projection device of this invention is simple in structure, effective in use and very reliable. It provides an aesthetically unobjectionable and socially acceptable means to use snuff. It is also an attractive desk or table accessory.

BRIEF DESCRIPTION OF THE DRAWINGS

FIG. 1 is a front perspective view of the snuff projection device of the present invention, with some portions cut away to show its structure.

BRIEF DESCRIPTION OF THE PREFERRED EMBODIMENT

Referring now to the drawing, the snuff projection device, designated generally by the reference numeral 10 is shown in its normal position just prior to use. Snuff projection device 10 has a base 12 and a mirror mount 14 to hold a mirror (not shown) for the user's convenience. A vertical nose positioning member 16 is located such that the user can view his nose in the mirror. In use, the user places his upper lip against the front of nose position member 16 such that the base of his nose rests on the contoured upper edge of nose position member 16 and his nostrils overhang nose position member 16 in a rearward direction. Immediately behind nose position member 16 is snuff projection lever 18, which is an elongated, pivotally mounted lever extending toward the rear of base 12. Snuff projection lever 18 is pivotally mounted on a fulcrum 20 mounted in pivot blocks 22. Fulcrum 20 is fixed rearward of the center-point of snuff projection lever 18 so that snuff projection lever 18 normally slopes downward behind nose position member 16 and normally slopes upward toward the rear of base 12, in its non-operative position. Snuff projection lever 18 has two spaced apart depressions 24 near its forward end, each depression being deep enough to hold a pinch of snuff. Depressions 24 are spaced such that when the forward end of snuff projection lever is suddenly pivoted upward, the snuff in depressions 24 will be projected into the nostrils overhanging nose position member 16.

A spring-loaded, pivotally mounted, elongated striking member 26 is used to cause snuff projection lever 18 to pivot suddenly. Striking member 26 extends above and across the rear of base 12 and is pivotally mounted in pivot blocks 28, where it pivots about fulcrum 30, which is positioned near its non-striking end 44. Striking member 26 has a striking end which is designated by the reference number 32. Striking member 26 has a spring 34 mounted within pivot blocks 28 which exerts an upward pressure on the non-striking end 44 of striking member 26, causing its striking end 32 to pivot downward toward base 12, which is its striking position. To restrain striking member 26 from resting in its striking position under normal, non-operating conditions, a restraining member 36 is utilized. Restraining member 36 is also a spring-loaded, pivotally mounted elongated rod positioned horizontally above the rear of base 12 in substantial alignment with the longitudinal axis of striking member 26. Restraining member 36 has a length sufficient to engage and restrain the striking end 32 of striking member 26. Restraining member 36 is pivotally mounted within pivot blocks 38. A spring 40 is positioned toward the outside of its fulcrum 42 such that spring 40 holds rstraining member 36 in a substantially horizontal position. Restraining member 36 extends inwardly slightly beyond the striking end 32 of striking member 26 and restraining member 36, and the abutting ends 32, 46 of these members are complementary in shape to permit their smooth operation.

To restrain striking member 26, its outer end 44 is depressed against the force of spring 34, thus causing the striking edge 32 of striking member 26 to pivot upwardly to the position shown in dotted lines. As striking edge 32 pivots upward, it pushes the restraining edge 46 slightly upward momentarily. Under the pressure of spring 40, restraining member 36 returns to its normal horizontal position. Releasing pressure on end 44 of striking member, its striking edge 32 will come to rest on restraining edge 46 of restraining member 36, as shown in outline in the FIGURE.

To operate snuff projection device 10, the user positions his nostrils over contoured nose position member 16 and pinches of snuff are placed in depressions 24 in the downward sloping end of projection lever 18. Striking member 26 is held in its restrained position by restraining member 36. Then the outer end of 48 of restraining member 36 is depressed against the force of spring 40. This causes its restraining edge 46 to pivot upward to release striking edge 32 of striking member 26. Striking edge pivots downward suddenly under pressure from spring 34, striking the rear edge of projection lever 18. This causes the forward edge of snuff projection lever 18 to pivot upward suddenly, thus projecting the snuff in depressions 22 into the nostrils of the user. After use, the striking member 26 is reset to its restrained position and snuff projection device is ready for operation again.

Snuff projection device is a novel and effective means for the projection of snuff into the nostrils. It is simple and reliable, while its use is aesthetically unobjectionable. It makes an attractive desk or table top accessory. It can also be hand held, an opening 50 being provided for a single handed grip of its base 12.

While I have illustrated and described one embodiment of my novel snuff projection device, many other variations may occur to those skilled in the art. My invention includes all those variations which fall within the scope of the appended claims.

I claim:

1. A device for the projection of snuff into the nostrils of a user comprising:

a base;

a nose positioning member secured to the front edge of said base;

said nose positioning member being a vertical member whose upper edge is contoured to fit under the base of the nose of the user when upper lip of the user is positioned against its vertical face such that the nostrils of the user overhang the nose positioning member;

a snuff projection means positioned adjacent to said nose positioning member such that snuff may be projected from said snuff projection means into nostrils positioned over said nose positioning member;

said snuff projection means comprising:

an elongated, rearwardly extending, pivotally mounted snuff projection lever;

a fulcrum for said snuff projection lever positioned rearward of its center point;

pivot blocks mounted on said base to support said fulcrum;

the forward edge of said snuff projection lever normally sloping downward toward and almost abutting said vertical nose positioning member;

a pair of spaced apart depressions near the forward edge of said snuff projection lever;

each of said depressions of a size sufficient to hold a pinch of snuff and spaced to be located under nostrils overhanging said nose positioning member;

striking means to cause said snuff projection means to project snuff upward into the nostrils of the user;

restraining means to restrain said striking means when said striking means is in a spring loaded pre-striking position;

means to release said striking means to strike said projection means resulting in the projection of snuff into the nostrils of the user.

2. The snuff projection device of claim 1 further including a mirror support member mounted on said base to hold a mirror such that the user may view the positioning of his nose on the nose positioning member.

3. The snuff projection device of claim 1 wherein said striking means comprises:

a pair of pivot blocks mounted on said base;

an elongated striking member pivotally mounted within said pivot blocks and extending horizontally across the rear of said base such that its striking edge can engage the rear edge of said snuff projection lever;

a spring mounted in said pivot blocks such that it forces the non-striking end of said striking member upward and its striking end downward;

the striking edge of said striking member being downwardly inclined and complementary to the restraining edge of said restraining means.

4. The snuff projection device of claim 1 wherein said restraining means further comprises:

a pair of pivot blocks mounted on said base;

an elongated restraining member pivotally mounted within said pivot blocks and extending horizontally partially across the rear of said base such that its restraining edge can engage the striking edge of said striking means;

a spring mounted in said pivot blocks such that it forces said restraining member to remain in a substantially horizontal position until pressure is exerted on either end of said restraining member;

said restraining member in its normal horizontal position serving to restrain the striding edge of said striking member from pivoting downward towards said snuff projection lever.

5. The snuff projection device of claim 1 wherein said base further includes at least one hole for single-hand gripping of said snuff projection device.

* * * * *